US006406098B1

(12) United States Patent
Linder

(10) Patent No.: US 6,406,098 B1
(45) Date of Patent: Jun. 18, 2002

(54) OTTOMAN WITH THERMALLY INSULATED CHAMBER

(76) Inventor: Steven G. Linder, 3010 Westchester Ave., Purchase, NY (US) 10577

( * ) Notice: Subject to any disclaimer, the term of this patent is extended or adjusted under 35 U.S.C. 154(b) by 0 days.

(21) Appl. No.: 09/568,701

(22) Filed: May 11, 2000

(51) Int. Cl.[7] ..... A47C 16/02

(52) U.S. Cl. ..... 297/452.41; 5/654; 5/655.3; 5/694; 220/592.2

(58) Field of Search ..... 297/452.41; 5/644, 5/654, 655.3, 656, 694; 220/592.2, 592.23, 592.27

(56) References Cited

U.S. PATENT DOCUMENTS 505,873 A * 10/1893 Bomgardner ..... 5/655.3
2,987,735 A * 6/1961 Nail ..... 297/452.41
5,302,003 A * 4/1994 Xenofos ..... 297/423.41
5,951,111 A * 9/1999 Klimenko ..... 297/452.41
6,089,668 A * 7/2000 Peterson ..... 297/452.41
6,179,155 B1 * 1/2001 Komiya et al. ..... 220/592.2

* cited by examiner

*Primary Examiner*—Peter R. Brown
(74) *Attorney, Agent, or Firm*—Amster, Rothstein & Ebenstein

(57) ABSTRACT

An ottoman with a thermally insulated chamber includes an airtight inner wall and an airtight outer wall, the inner wall being coaxial with and shorter that the outer wall; an airtight top wall secured to the periphery of the top of the outer wall, and an airtight bottom wall secured to the peripheries of the bottoms of the inner and outer wall; and an airtight mid-level wall intermediate the tip and bottom walls and secured to the periphery of the top of the inner wall. The inner wall and the mid-level wall define the interior of an axially-extending thermally insulated chamber closed at the chamber top and open at the chamber bottom. Preferably the inner, outer, top, bottom and mid-level walls cooperatively define an airtight thermally insulating chamber filled with a thermally-insulating body of stagnant gas.

9 Claims, 3 Drawing Sheets

OTTOMAN WITH THERMALLY INSULATED CHAMBER

BACKGROUND OF THE INVENTION

The present invention relates to ottomans and more particularly to multi-functional ottomans.

Ottomans are well-known in the furniture art. While originally intended to be used for a support for the legs of a seated person, they also are occasionally used as seats in and of themselves. The footprint of an ottoman is relatively large and often occupies a significant amount of the available space in an apartment. In an apartment where available space is at a premium, the luxury of an ottoman which only functions as a conventional ottoman is excessive and impractical.

An ice bucket or like thermally insulated container for use in a living room bar is typically substantially smaller than an ottoman and does not have a footprint which unduly impacts on the available space, even in a relatively small apartment. However, when the container is not a simple ice bucket, but rather a relatively large chest for containing food, chilled beer, wine bottles, sandwiches and like articles which benefit from the cooling effect of ice cubes, ice packs, or the like placed in the chamber, the size of the container increases greatly and again makes an unjustified demand on the available space of the apartment.

Accordingly, it is an object of the present invention to provide a multi-functional ottoman.

Another object is to provide such an ottoman defining a thermally insulated chamber.

A further object is to provide such an ottoman which can receive articles to be cooled and cooling means within the thermally insulated chamber.

It is also an object of the present invention to provide such an ottoman which is simple and economical to manufacture, use and maintain.

SUMMARY OF THE INVENTION

It has now been found that the above and related objects of the present invention are obtained in an ottoman with a thermally insulated chamber according to the present invention. The ottoman with a thermally insulated chamber comprises an airtight inner wall and an airtight outer wall, the inner wall being coaxial with and shorter than the outer wall; an airtight top wall secured to the periphery of the top of the outer wall and an airtight bottom wall secured to the peripheries of the bottoms of the inner and outer walls; and an airtight mid-level wall intermediate the top and bottom walls and secured to the periphery of the top of the inner wall. The inner wall and the mid-level wall define the interior of an axially-extending thermally insulated chamber closed at the chamber top and open at the chamber bottom.

In a preferred embodiment the inner, outer, top, bottom and mid-level walls cooperatively define an airtight thermally insulating chamber filled with a thermally-insulating body of stagnant gas.

Preferably each of the walls is flexible, and the ottoman is inflatable and deflatable.

The present invention also encompasses, in combination, the ottoman described hereinabove and a watertight basin disposed within the insulated chamber, the basin having an open basin end and a closed basin end such that, when the combination is in an inverted orientation, the basin will support articles placed therein.

Preferably the basin is snugly received by, but removable from, the insulated chamber of the ottoman. When the combination is in an inverted orientation, it may additionally include cooling means (e.g., ice) supported in the basin for cooling articles therein.

Alternatively, the bottom wall of the ottoman and the closed basin end define a common generally planar surface.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
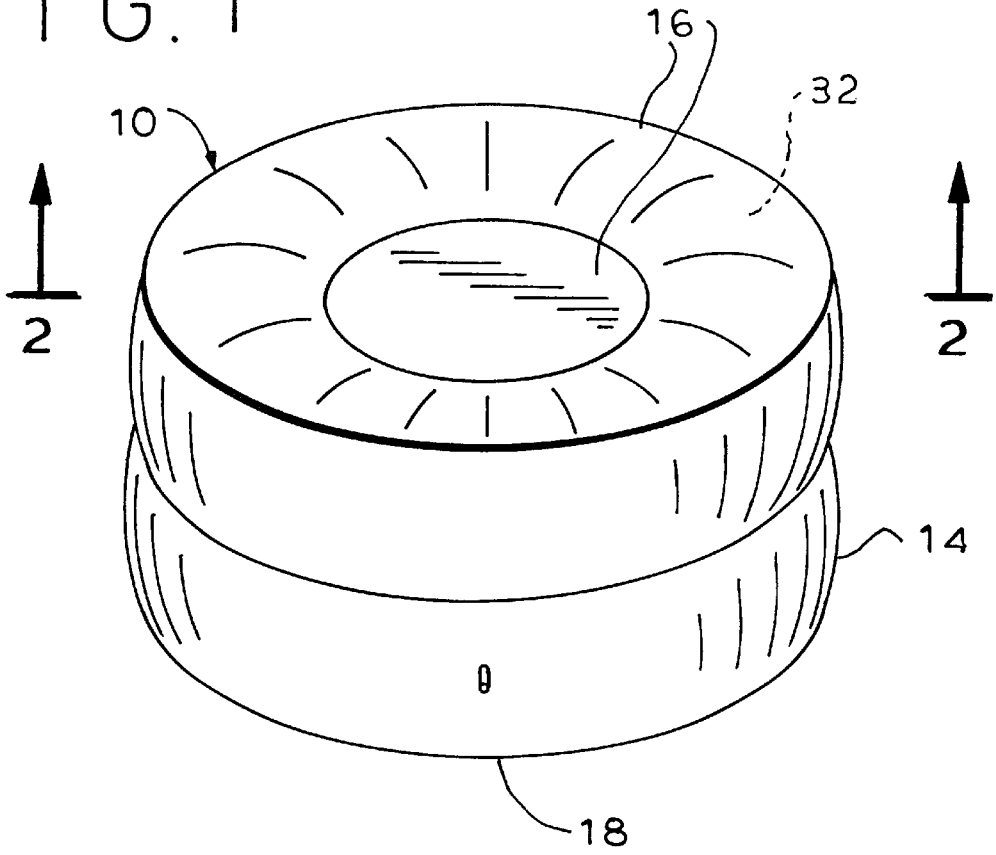
FIG. 1 is an isometric view of an ottoman according to the present invention in an upright orientation.
Figure 2:
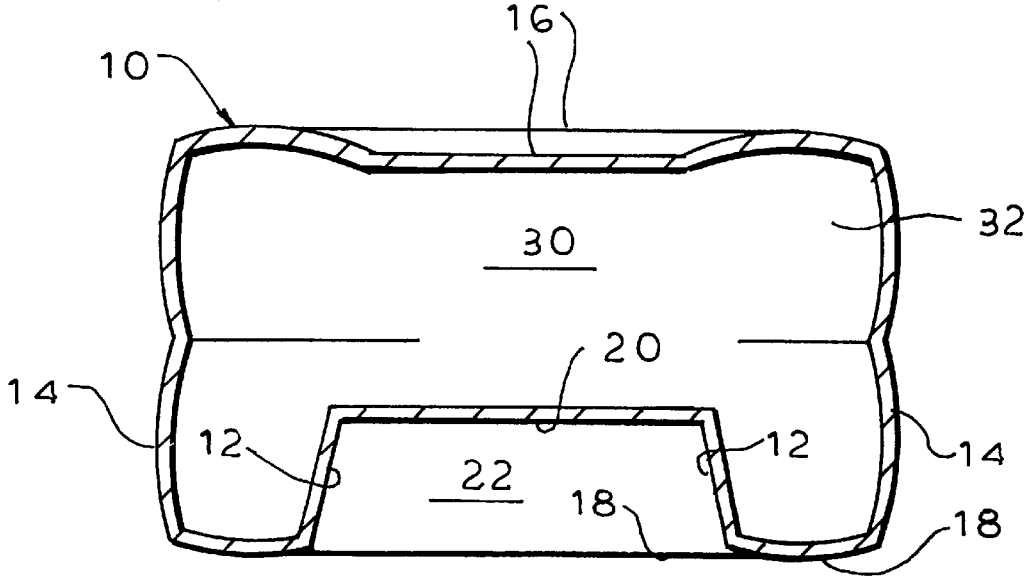
FIG. 2 is a sectional view thereof taken along the line 2—2 of FIG. 1.

Referring now to FIGS. 1–2, therein illustrated is an ottoman according to the present invention, generally designated by the reference numeral 10. The ottoman includes an airtight inner wall 12, and an airtight outer wall 14. The inner and outer wall 12, 14 are coaxial, with the inner wall 12 being shorter than the outer wall 14 for reasons which will become apparent hereinafter. An airtight top wall 16 is secured to the periphery of the top of the outer wall 14, and an airtight bottom wall 18 is secured to the peripheries of the bottoms of the inner and outer walls 12, 14. An airtight mid-level wall 20 is disposed intermediate the top and bottom walls 16, 18 and is secured to the periphery of the top of the inner wall 12.

The inner wall 12 and the mid-level wall 20 define the interior of an axially-extending thermally insulated chamber 22. The chamber 22 is closed at the top 24 (by the mid-level wall 20) and open at the chamber bottom 26. The inner wall 12, outer wall 14, top wall 16, bottom wall 18, and mid-level wall 20 cooperatively define an airtight thermally insulating chamber 30 which, when the ottoman is in an inflated state, is filled with a thermally-insulating body 32 of stagnant gas (such as air).

While the various walls 12–20 are illustrated as cylindrical in configuration, clearly other configurations may be employed in order to vary the outer peripheral configuration of the ottoman and/or the outer peripheral configuration of the thermally insulated chamber 22. For example, the outer periphery of the ottoman 10 may be square, while the outer periphery of the insulated chamber 22 is cylindrical (circular).

The top wall 16, bottom wall 18, and mid-level wall 20 are secured to the respective peripheries in an airtight manner. For example, where the afore-mentioned components of the ottoman are formed of plastic, the adjacent walls may be secured together by heat sealing, gluing, or the like.

The various walls 12, 14, 16, 18, 20 of the ottoman are preferably flexible to enable the ottoman to be inflated for one of its multi-functional uses and deflated for compact storage at other times. A valve (not shown) is provided to facilitate inflation and deflation of the ottoman.

The various walls may be formed of any of the airtight materials commonly used in inflatable products, especially inflatable products which are under relatively high pressure when inflated and in use.

It will be appreciated that, when the ottoman is an upright orientation, it may be used in the conventional manner as a foot support or even as a chair.

Figure 3:
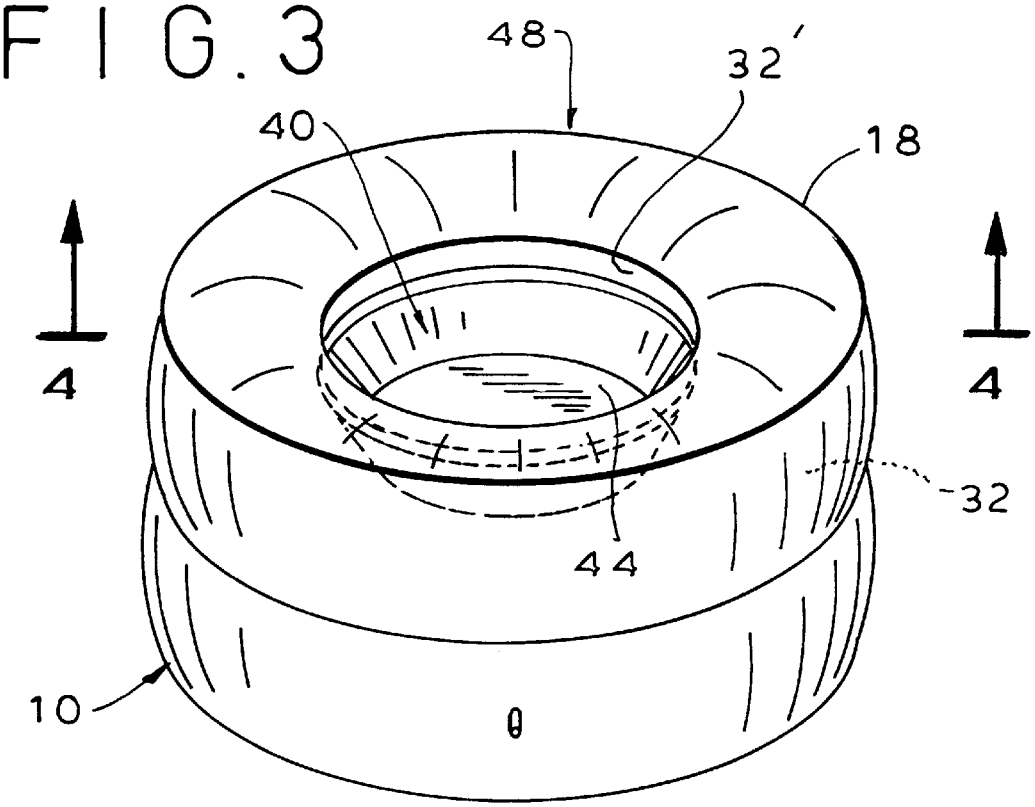
FIG. 3 is an isometric view of an ottoman/basin combination in an inverted orientation
Figure 4:
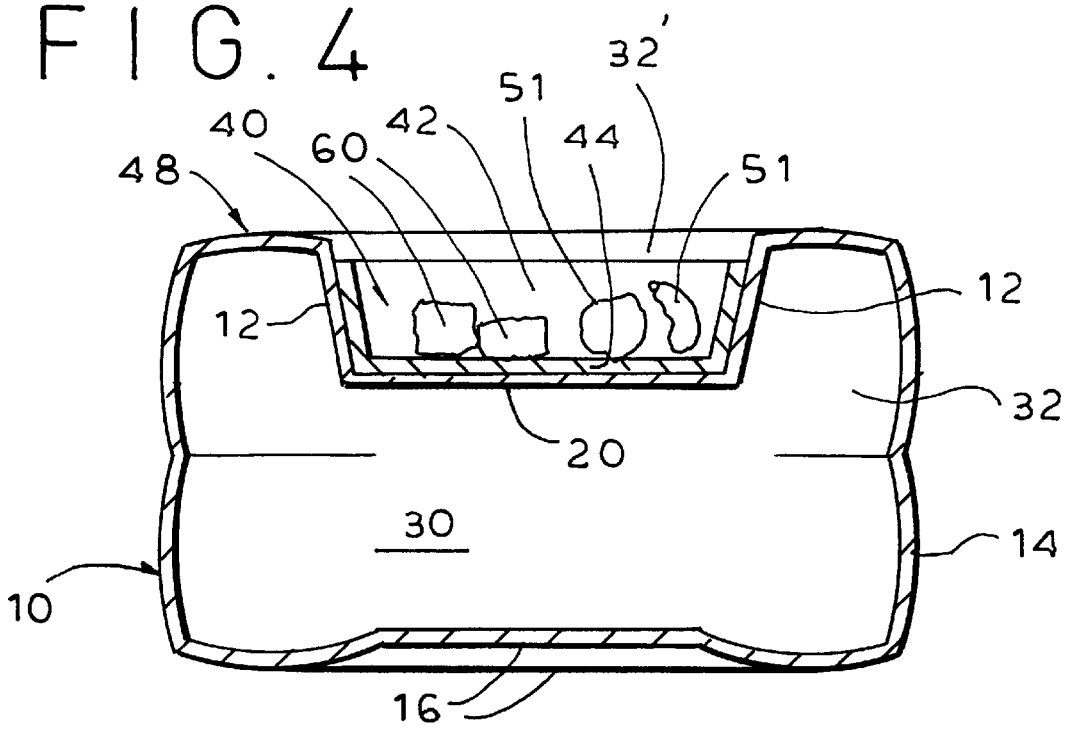
FIG. 4 is a sectional view thereof taken along the line 4—4 of FIG. 3.

Referring now in particular to FIGS. 3–4, the ottoman 10 as described hereinabove is used in conjunction with a watertight basin, generally designated 40, disposed within the insulated chamber 22 to form a combination, generally designated 48. The basin 40 has an open basin end 42 and a closed basin end 44, the open basin end 42 preferably being of greater diameter than the closed basin end 44. Preferably the outer periphery of the basin 40 is snugly received by, but is removable from, the insulated chamber 22 of the ottoman 10. When the combination 48 is in an inverted orientation (as illustrated in FIG. 3) the basin 40 will support articles placed therein. Indeed, the present invention contemplates the inverted ottoman 10 with the basin 40 within the insulated chamber 22 and one or more cooling means 50 (such as ice cubes, ice packs, and the like) supported in the basin 40 for cooling articles 51 placed therein (such as drinks, sandwiches, and the like).

Thus the ottoman 10 of the present invention serves at least a dual function: in the upright orientation of FIGS. 1–2 it functions as a conventional ottoman (as a leg support or seat) and in the inverted orientation of FIGS. 3–4 it functions as an open top cooler or ice chest. When the ottoman 10 is in the inverted orientation, preferably the basin 40 and any articles therein are disposed lower than the bottom wall 18 so that the insulated chamber 22 is insulated from the ambient air by the stagnant body 32 of air within the insulating chamber 30 (on the bottom and sides thereof). The insulated chamber 22 is further insulated by the inner and outer walls 12, 14 extending above the top of the basin 40 and any articles 51 therein and, in effect, to some degree confining a stagnant body 32 of air immediately above the basin 40.

It will be appreciated that the ottoman may be filled with a gas other than air, preferably one which has a lower coefficient of heat transfer so that it acts more like a vacuum about the insulated chamber 22 (so that the ottoman 10 functions somewhat like a Thermos or insulated bottle). The ottoman of the present invention functions in an upright orientation as an ottoman, but as an open ice chest in an inverted orientation. The user can decide its appropriate function (and hence appropriate orientation) depending upon the exigencies of the moment.

Figure 5:
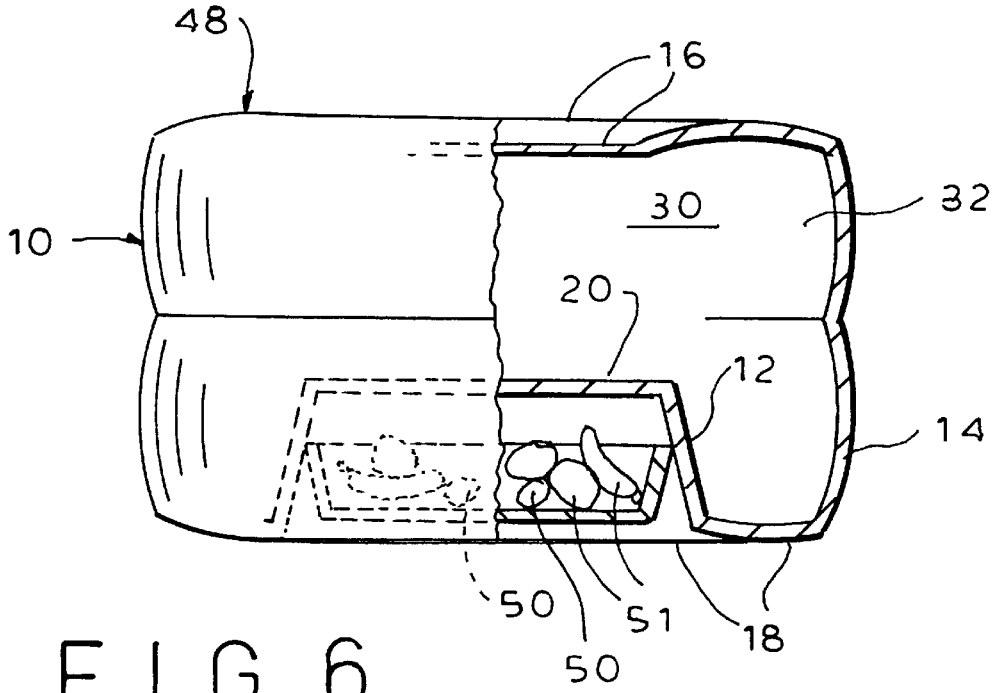
FIG. 5 is a front elevational view of another embodiment of the combination.
Figure 6:
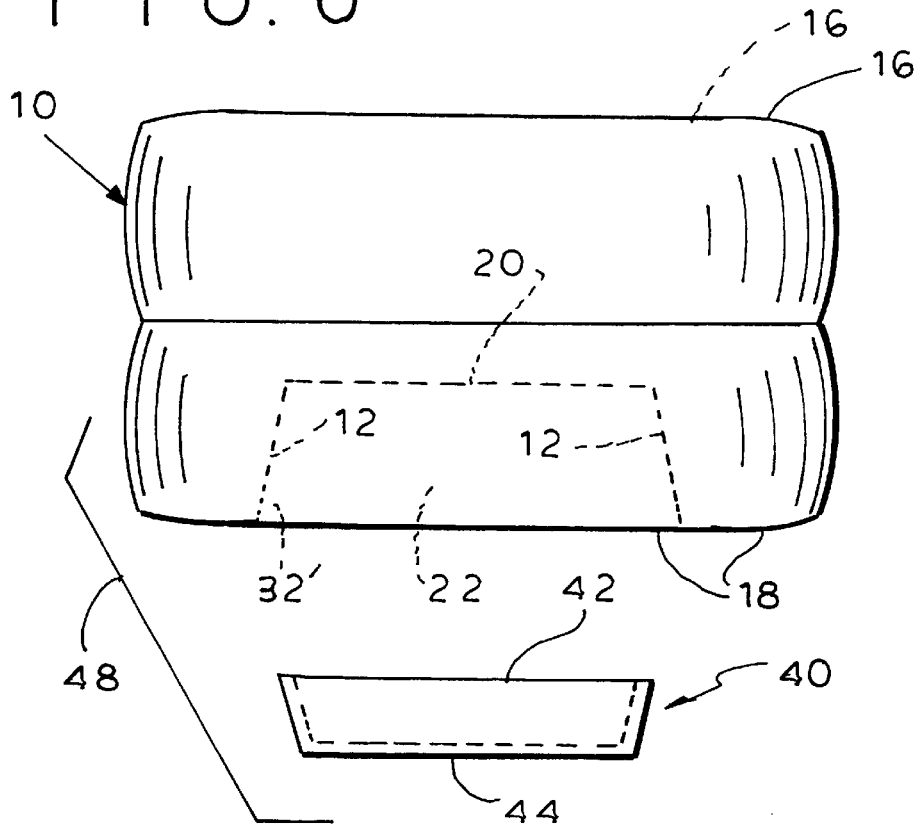
FIG. 6 is an exploded front elevational view thereof.

Referring now to FIGS. 5–6 in particular, in another embodiment the combination ottoman/basin 48 of the present invention may also be formed by having the bottom wall 18 of the ottoman 10 and the closed end 44 of the basin 40 defining a common generally planar surface, with the closed basin end 44 closing the inverted chamber bottom 26. In this manner, even while cooling means 50 and other articles are disposed within the upright basin 40, the ottoman can be disposed in its upright position over the basin 40 such that the basin 40 acts as a closure for the insulated chamber 22. Preferably the basin 40 is less snugly received by the insulated chamber 22 in this instance, so that the ottoman 10 may be easily and rapidly removed from the basin 40 to allow access to the contents of the basin and then replaced thereover to maintain the articles in the basin cold. If desired, the basin 40 may be placed within the insulated chamber 22 with the chamber bottom end 44 spaced above the floor (that is, above the generally planar surface on which rests the ottoman bottom wall 18) so that there is a stagnant air pool (not shown) intermediate the basin closed end 44 and the support, thereby enhancing the insulation about the basin 40.

To summarize, the present invention provides a multi-functional ottoman which defines a thermally insulated chamber for the receipt of articles to be cooled and cooling means within the insulated chamber. The multi-functional ottoman is simple and economical to manufacture, use and maintain.

Now that the preferred embodiments of the present invention have been shown and described in detail, various modifications and improvements thereon will become readily apparent to those skilled in the art. Accordingly, the spirit and scope of the present invention is to be construed broadly and limited only by the appending claims, and not by the foregoing specification.

I claim:

1. An ottoman with a thermally insulated chamber comprising:

(A) an airtight inner wall;

(B) an airtight outer wall, said inner wall being coaxial with and shorter than said outer wall;

(C) an airtight top wall secured to the periphery of the top of said outer wall;

(D) an airtight bottom wall secured to the peripheries of the bottoms of said inner and outer walls;

(E) an airtight mid-level wall intermediate said top and bottom walls and secured to the periphery of the top of said inner wall;

said inner wall and said mid-level wall defining the interior of an axialy-extending thermally insulated chamber closed at the chamber top and open at the chamber bottom;

each of said walls being flexible, and said ottoman being inflatable and deflatable.

2. In combination, said ottoman of claim 1, and a watertight basin disposed within said insulated chamber, said basin having an open basin end and a closed basin end such that, when said combination is in an inverted orientation, said basin will support articles placed therein.

3. The combination of claim 2 wherein said basin is snugly received by, but removable from, said insulated chamber of said ottoman.

4. The combination of claim 3 wherein said combination is in an inverted orientation and additionally includes cooling means supported in said basin for cooling articles therein.

5. The combination of claim 4 wherein said combination includes ice as cooling means in said basin.

6. In combination, said ottoman of claim 1 and a watertight basin disposed within said insulated chamber, said basin having an open basin end and a closed basin end, said closed basin end closing said insulated chamber bottom, and said bottom wall of said ottoman and said closed basin end defining a common generally planar surface.

7. An inflatable and deflatable ottoman with a thermally insulated chamber comprising:

(A) an airtight, flexible cylindrical inner wall;

(B) an airtight, flexible cylindrical outer wall, said inner wall being coaxial with and shorter than said outer wall;

(C) an airtight, flexible cylindrical top wall secured to the periphery of the top of said outer wall;

(D) an airtight, flexible cylindrical bottom wall secured to the peripheries of the bottoms of said inner and outer walls;

(E) an airtight, flexible cylindrical mid-level wall intermediate said top and bottom walls and secured to the periphery of the top of said inner wall;

said inner wall and said mid-level wall defining the interior of an axially-extending thermally insulated chamber closed at the chamber top and open at the chamber bottom; and said inner, outer, top, bottom and mid-level walls cooperatively define an airtight thermally insulating chamber filled with a thermnally-insulating body of stagnant gas.

8. In combination, said ottoman of claim 7 and a watertight basin disposed within said insulated chamber, said basin having an open basin end and a closed basin end such that, when said combination is in an inverted orientation, said basin will support articles placed therein;

said basin being snugly received by, but removable from, said insulated chamber of said ottoman;

said combination, when in an inverted orientation, additionally including cooling means supported in said basin for cooling articles therein.

9. In combination, said ottoman of claim 7 and a watertight basin disposed within said insulated chamber, said basin having an open basin end and a closed basin end, said closed basin end closing said insulated chamber bottom, and said bottom wall of said ottoman and said closed basin end defining a common generally planar surface.

* * * * *